US007233272B1

(12) United States Patent
Yen

(10) Patent No.: US 7,233,272 B1
(45) Date of Patent: Jun. 19, 2007

(54) DIGITAL DATA DRIVER AND DISPLAY DEVICE USING THE SAME

(75) Inventor: Chih-Jen Yen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 11/403,341

(22) Filed: Apr. 12, 2006

(30) Foreign Application Priority Data

Feb. 24, 2006 (TW) ..... 95106260 A

(51) Int. Cl.
*H03M 1/66* (2006.01)

(52) U.S. Cl. ..... 341/144; 345/87

(58) Field of Classification Search ..... 341/144; 345/87, 98, 88
See application file for complete search history.

(56) References Cited

U.S. PATENT DOCUMENTS

| | | | | |
|---|---|---|---|---|
| 5,627,537 | A * | 5/1997 | Quinlan et al. | 341/144 |
| 6,744,415 | B2 * | 6/2004 | Waterman et al. | 345/87 |
| 2004/0196244 | A1 * | 10/2004 | Lin | 345/98 |
| 2006/0114205 | A1 * | 6/2006 | Shen et al. | 345/88 |

* cited by examiner

*Primary Examiner*—Peguy JeanPierre
(74) *Attorney, Agent, or Firm*—J.C. Patents

(57) ABSTRACT

A digital data driver including a receiving unit and a digital-to-analog (D/A) converting unit is provided. The D/A converting unit is used to convert N digital data outputted from the receiving unit into corresponding N analog data. The D/A converting unit includes a grey-level voltage generator and K sub D/A converting units. The grey-level voltage generator provides $2^M$ grey-level voltages. The $i^{th}$ sub D/A converting unit includes $2^M$ buffers and $$\frac{N}{K} D/A$$

converters. In which, each buffer receives and outputs a corresponding grey-level voltage. The $j^{th}$ D/A converter receives the $$\left[(i-1)\times\frac{N}{K}+j\right]^{th}$$

digital data, and selects and outputs one of the grey-level voltages that passed the buffers as the $$\left[(i-1)\times\frac{N}{K}+j\right]^{th}$$

analog data according to the $$\left[(i-1)\times\frac{N}{K}+j\right]^{th}$$

digital data, where N, K, $$\frac{N}{K},$$

i and j are the positive integers, $$1 \le i \le K \text{ and } 1 \le j \le \frac{N}{K}.$$

12 Claims, 8 Drawing Sheets

| E1 | A1 |
|---|---|
| e1 | V1 |
| e2 | V2 |
| e3 | V3 |
| e4 | V4 |

| D1 | | A1 |
|---|---|---|
| d1 | d0 | |
| 0 | 0 | V1 |
| 0 | 1 | V2 |
| 1 | 0 | V3 |
| 1 | 1 | V4 |

DIGITAL DATA DRIVER AND DISPLAY DEVICE USING THE SAME

CROSS-REFERENCE TO RELATED APPLICATION

This application claims the priority benefit of Taiwan application serial no. 95106260, filed on Feb. 24, 2006. All disclosure of the Taiwan application is incorporated herein by reference.

BACKGROUND OF THE INVENTION

1. Field of the Invention

The present invention relates to a digital data driver, and more particularly, to a digital data driver using a less number of output buffers, and a display device using the digital data driver.

2. Description of the Related Art

In the Liquid Crystal Display (LCD) device, the data driver (or referred as a source driver) controls and drives the LCD panel according to a digital input signal from the timing controller. FIG. 1A shows a block diagram of a conventional N-channel M-bit digital data driver, and FIG. 1B shows a timing diagram of the clock signal and the control signals of the conventional data driver. Referring to FIG. 1A, the data driver 100 comprises an input unit 110, a digital-to-analog (D/A) converting unit 120, and an output buffer 130. Wherein, the input unit 110 comprises a shift register 111, a first line latch 112, a second line latch 113, and a level shifter 114.

Referring to FIGS. 1A and 1B, the shift register 111 is triggered by the clock signal CLK and the first control signal CT1, and the second line latch 113 is controlled by the second control signal CT2. When the first control signal is transited to the high level, the shift register 111 sequentially shifts the received first control signal CT1 according to the clock signal CLK, and provides (N/3) latch signals of different phases to the first line latch 112. The first line latch 112 sequentially receives and latches the input digital data stream IN1, IN2, and IN3 according to a latch signal provided by the shift register 111, wherein the digital data stream IN1, IN2, and IN3 respectively represents the red (R), green (G), and blue (B) pixel data, and each pixel data is represented by M bits.

When the entire line latch is filled with the digital data stream that is sequentially latched in the first line latch 112, the second control signal CT2 transits to the high level, thus the digital data latched in the first line latch 112 is transmitted and latched in the second line latch 113 simultaneously. Then, the level shifter 114 converts the digital data latched in the second line latch 113 into the data with a higher voltage level so as to accurately drive the D/A converting unit 120. The D/A converting unit 120 receives the M-bits digital data D1~D(N) that is provided by the level shifter 114 and converts the received digital data D1~D(N) into the corresponding analog data A1~A(N) such as the analog voltages. The output buffer 130 is configured to improve the driving capability of the analog data A1~A(N), such that the digital data driver can drive the LCD panel accurately. Then, the clock signal CLK and the first control signal CT1 transit to the high level again, thus the data in the first line latch 112 is refreshed and latched, and the processes mentioned above are repeated.

FIG. 2 shows a detailed block diagram of the D/A converting unit 120 and the output buffer 130 of FIG. 1A.

Referring to FIG. 2, the D/A converting unit 120 comprises N D/A converters 121~12(N), and each D/A converter may comprise a decoder and a switch set. For example, the D/A converter 121 comprises a decoder DEC1 and a switch set SW1. In addition, the D/A converting unit 120 further comprises a grey-level voltage generator 140. The grey-level voltage generator 140 generates the grey-level voltages V1~V($2^M$) of different levels by using the serially-connected resistors to divide the supply voltage difference (VDD–VSS). The output buffer 130 comprises N buffers BUF1~BUF(N).

Using the D/A converter 121 as an example, first the decoder DEC1 receives the M-bit digital data D1 and decodes it to the digital data E1. Then, the switch set SW1 selects and outputs the analog data A1 corresponding to the decoded digital data E1 (or the digital data D1) among the grey-level voltages V1~V($2^M$) according to the decoded digital data E1. Finally, the buffer BUF1 receives the analog data A1, such that the analog data OUT1 provided by the buffer BUF1 has enough driving ability to drive the LCD panel.

One embodiment of the D/A converter 121 is as shown in FIG. 3A, and the corresponding relationship between the decoded digital data E1 and the analog data A1 is as shown in FIG. 3B. In the present embodiment, the digital data D1 is, for example, represented by 2 bits, thus $2^2$ grey-level voltages V1~V4 are required. Accordingly, the purpose of the decoder DEC1 is to be adapted to the design of the switch set SW1, such that the received digital data D1 is decoded to the digital data E1 that is suitable for controlling the switch set SW1. Here, FIGS. 3A and 3B are only one of the designs. Another embodiment of the D/A converter 121 is as shown in FIG. 3C. In such case, the decoder is not required, and the corresponding relationship between the digital data D1 and the analog data A1 is as shown in FIG. 3D. In the present embodiment, the digital data D1 is, for example, represented by 2 bits, thus $2^2$ grey-level voltages V1~V4 are required. The digital data D1 can be directly applied to control the switch set SW1, and FIGS. 3C and 3D are only one of the designs.

SUMMARY OF THE INVENTION

Therefore, it is an object of the present invention to provide a digital data driver using a less number of output buffers for reducing the cost, and a display device using the same.

It is another object of the present invention to provide a digital data driver using a less number of output buffers for reducing the power consumption and heat generated thereon, and a display device using the same.

In order to achieve the objects mentioned above and others, the present invention provides a digital data driver that comprises a receiving unit and a D/A converting unit. The receiving unit receives at least a digital data stream and converts it to N digital data, wherein each digital data is M bits, and M and N are the positive integers. The D/A converting unit receives the N digital data and converts it to corresponding N analog data.

The D/A converting unit comprises a grey-level voltage generator and K sub D/A converting units. The grey-level voltage generator provides $2^M$ grey-level voltages, and the level of each grey-level voltage is not the same. The $i^{th}$ sub D/A converting unit of the K sub D/A converting units comprises $2^M$ buffers and $$\frac{N}{K} D/A$$

converters, wherein K, $$\frac{N}{K},$$

and i are the positive integers and $1 \leqq i \leqq K$. In the $i^{th}$ sub D/A converting unit, each buffer receives and outputs a corresponding grey-level voltage, and the $j^{th}$ D/A converter receives the $$\left[(i-1) \times \frac{N}{K} + j\right]^{th}$$

digital data and selects one of the grey-level voltages as the $$\left[(i-1) \times \frac{N}{K} + j\right]^{th}$$

analog data to output it according to the $$\left[(i-1) \times \frac{N}{K} + j\right]^{th}$$

digital data, where j is a positive integer and $$1 \leqq j \leqq \frac{N}{K}.$$

In an embodiment, the $j^{th}$ D/A converter comprises a decoder and a switch set. The decoder receives and decodes the $$\left[(i-1) \times \frac{N}{K} + j\right]^{th}$$

digital data to generate the decoded digital data. The switch set coupled to the decoder and the buffer selects and outputs one of the grey-level voltages that passed the buffers as the $$\left[(i-1) \times \frac{N}{K} + j\right]^{th}$$

analog data according to the decoded digital data. In another embodiment, the $j^{th}$ D/A converter only comprises a switch set, and the switch set coupled to the buffer selects and outputs one of the grey-level voltages that passed the buffers as the $$\left[(i-1) \times \frac{N}{K} + j\right]^{th}$$

analog data according to the received $$\left[(i-1) \times \frac{N}{K} + j\right]^{th}$$

digital data.

In order to achieve the objects mentioned above and others, the present invention further provides a display device that comprises the digital data driver mentioned above. In an embodiment, the display device is an LCD device.

As contrast to the conventional data driver, the buffers of the data driver in the present invention are disposed between the D/A converter and the grey-level voltage generator, thus, the N buffers required in this configuration are decreased to $K \times 2^M$ buffers. As for a 480-channel (N=480) 6-bit (M=6) data driver, if the D/A converters are divided into 4 groups (K=4), the present invention can effectively decrease 224 ($480-4 \times 2^6=224$) buffers in comparison to the conventional configuration, which significantly reduces the cost, power consumption, and heat generated thereon.

BRIEF DESCRIPTION DRAWINGS

The accompanying drawings are included to provide a further understanding of the invention, and are incorporated in and constitute a portion of this specification. The drawings illustrate embodiments of the invention, and together with the description, serve to explain the principles of the invention.

Figure 5A:
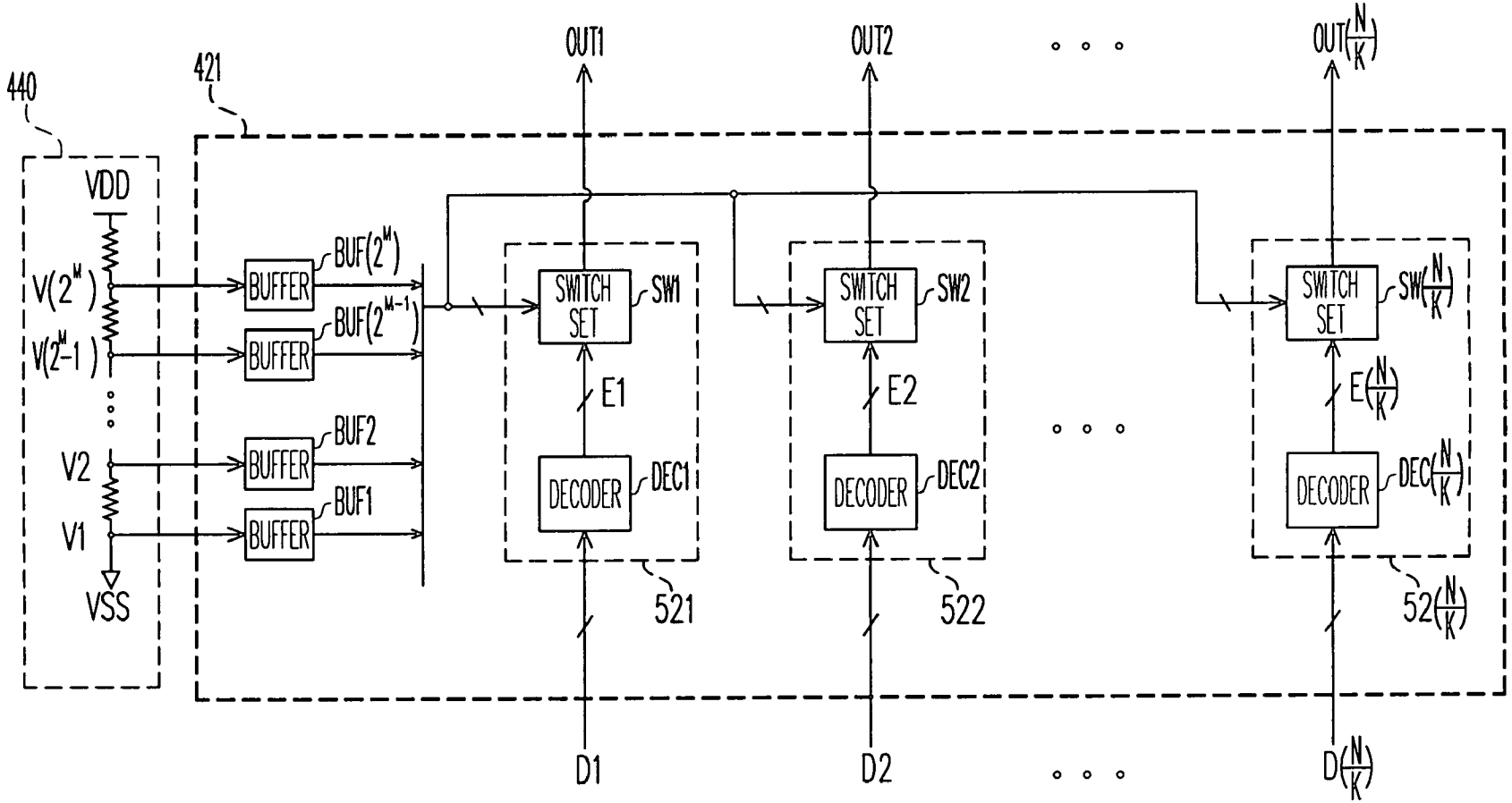
FIG. 5A shows an embodiment of the sub D/A converting unit 421 and the grey-level voltage generator 440 of FIG. 4.
Figure 5B:
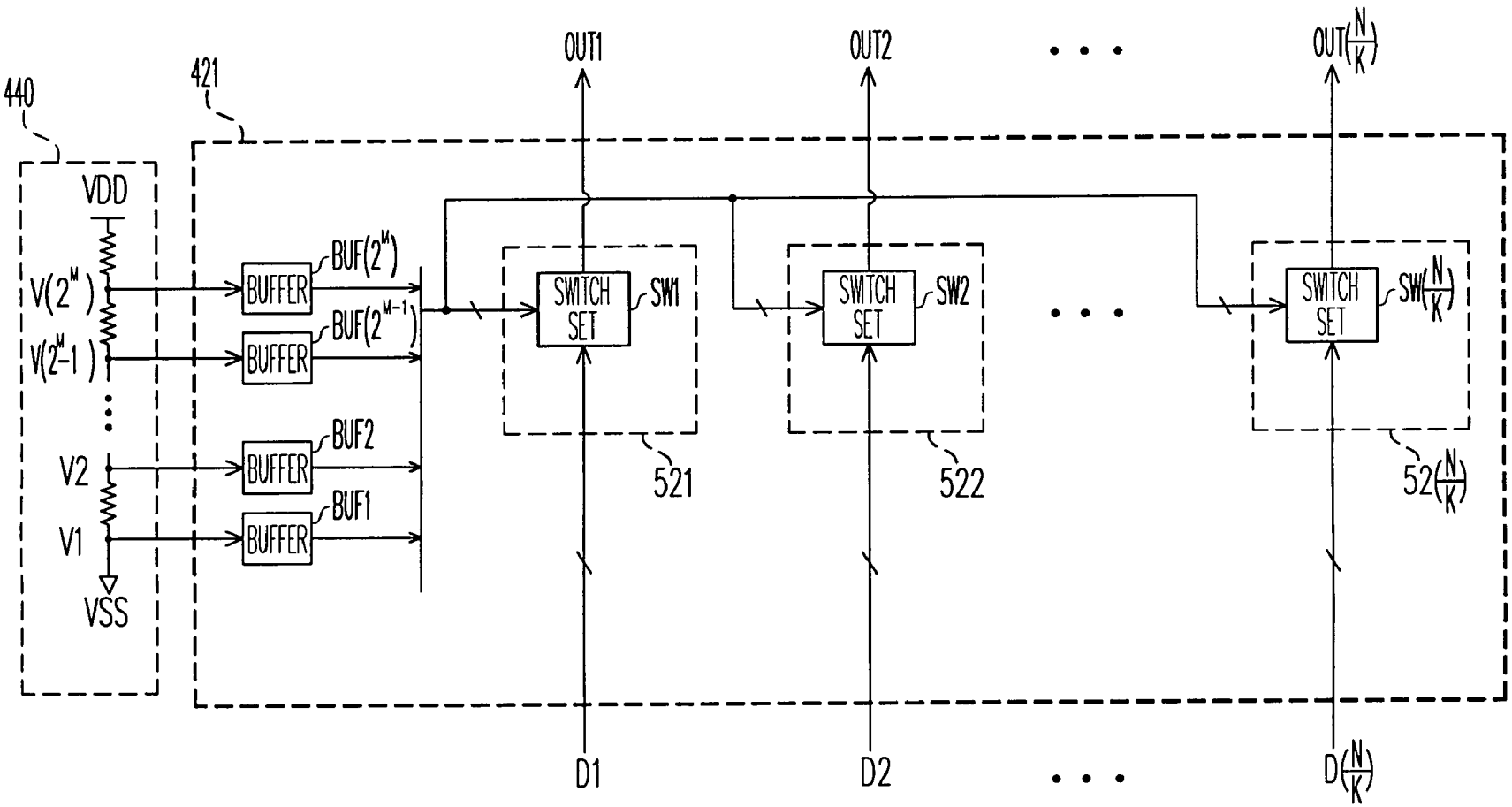
FIG. 5B shows another embodiment of the sub D/A converting unit 421 and the grey-level voltage generator 440 of FIG. 4.
Figure 6C:
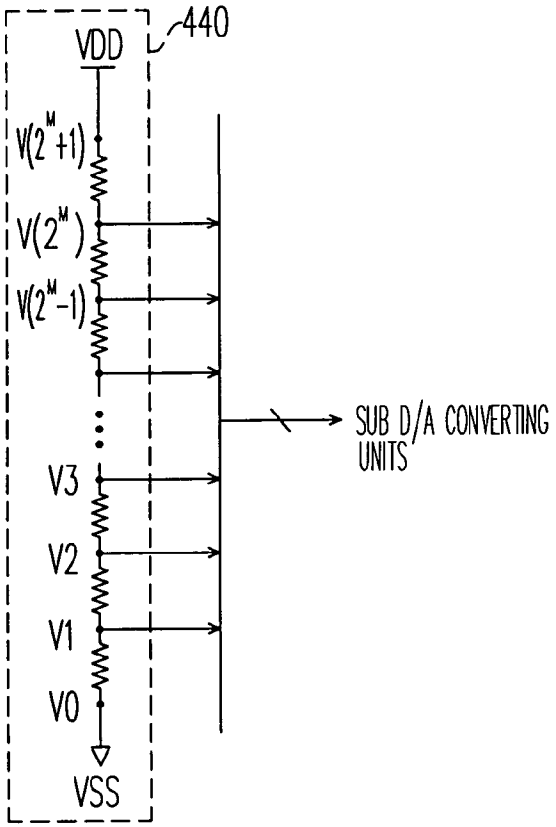
Figure 6B:
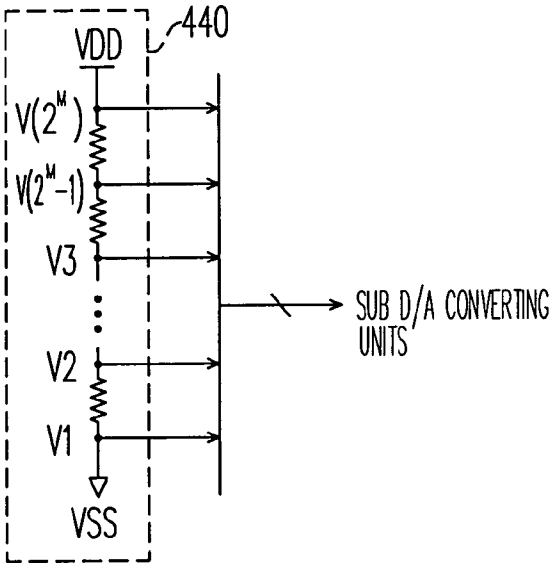
Figure 6A:
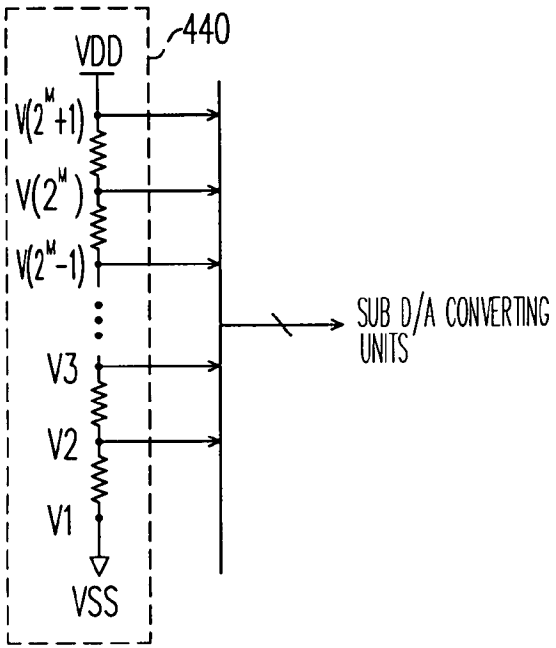

FIGS. 6A~6C show other optional embodiments of the grey-level voltage generator 440 of FIGS. 5A and 5B.

DESCRIPTION PREFERRED EMBODIMENTS

For an easy explanation of the embodiments, the red (R), green (G), and blue (B) digital data streams are exemplified herein for representing at least one of the digital data streams mentioned above.

Figure 4:
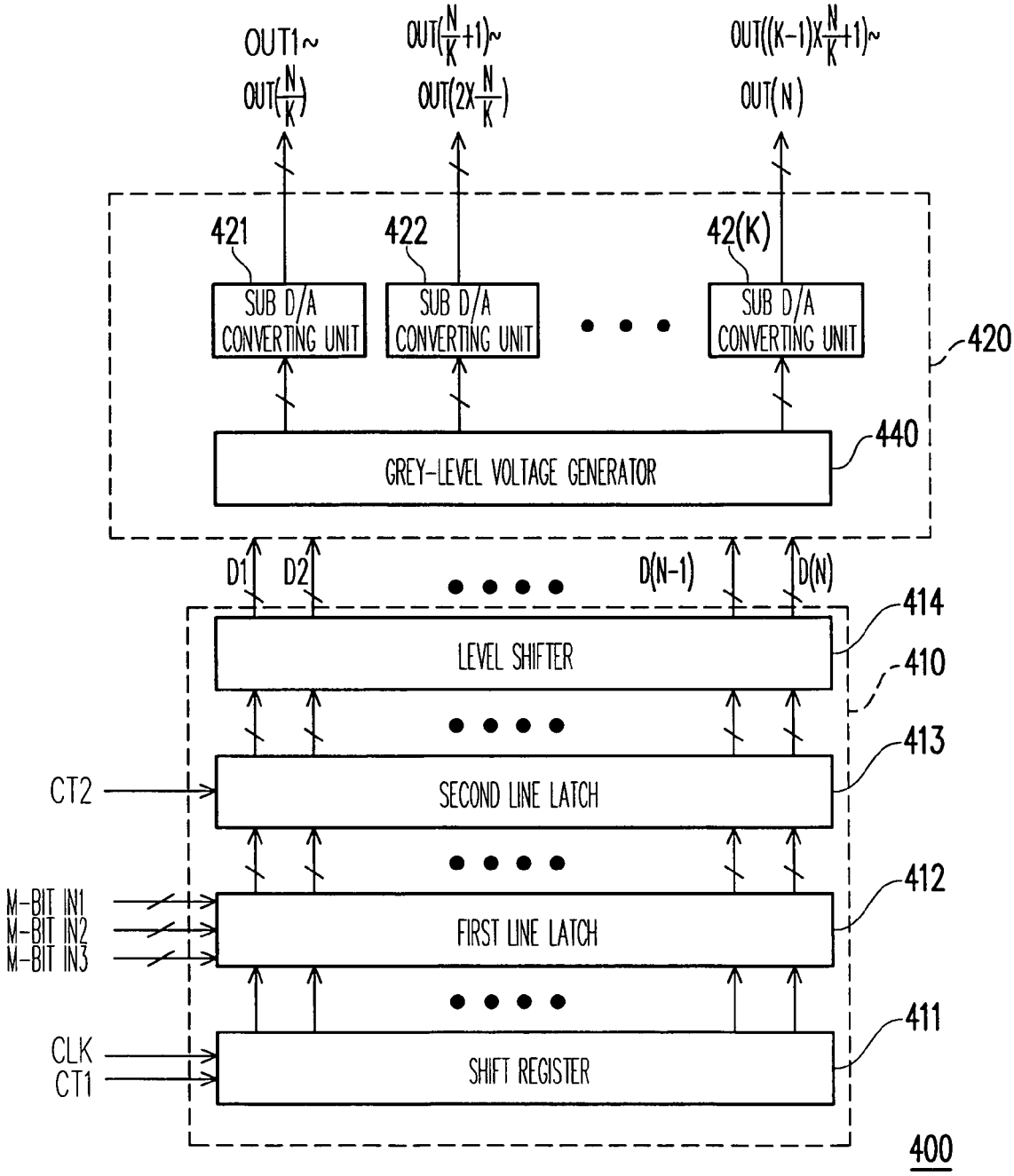
FIG. 4 shows a block diagram of an N-channel M-bit digital data driver according to an embodiment of the present invention.

FIG. 4 shows a block diagram of an N-channel M-bit digital data driver according to an embodiment of the present invention, where N and M are the positive integers. The data driver can be applied in the display device such as the LCD device, and the data driver controls and drives the display panel according to the digital input signal from the timing controller. Referring to FIG. 4, the data driver 400 comprises an input unit 410 and a D/A converting unit 420. Wherein, the input unit 410 comprises a shift register 411, a first line latch 412, a second line latch 413, and a level shifter 414. In addition, the timing diagram of the clock signal CLK and the control signals CT1, CT2 of the data driver 400 may be referred to FIG. 1B.

Figure 1A:
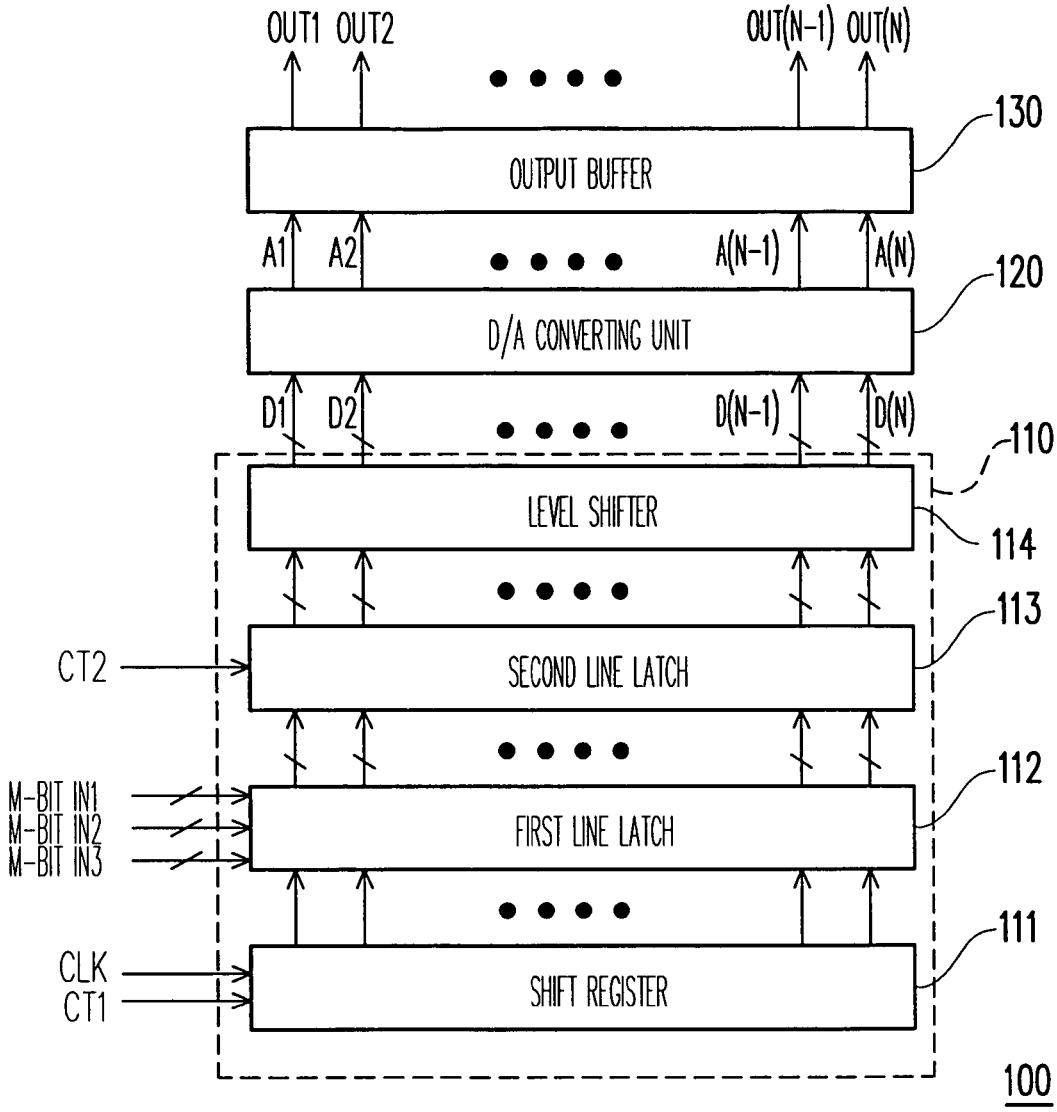
FIG. 1A(PRIOR ART)
FIG. 1A shows a block diagram of a conventional N-channel M-bit digital data driver.
Figure 1B:
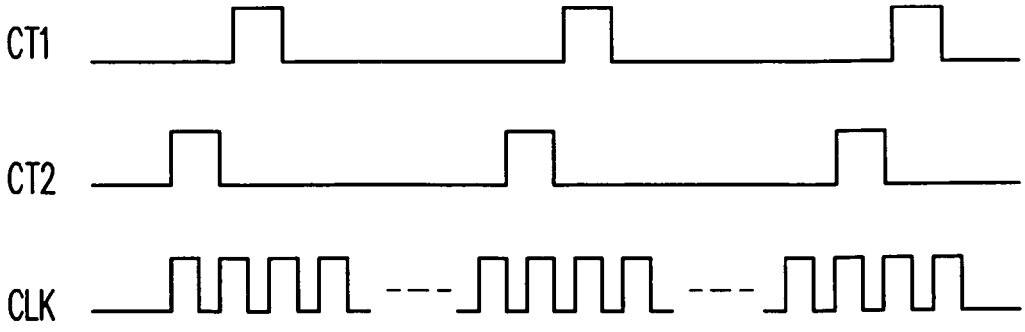
FIG. 1B(PRIOR ART)
FIG. 1B shows a timing diagram of the clock signal and the control signals of the conventional data driver.
Figure 2:
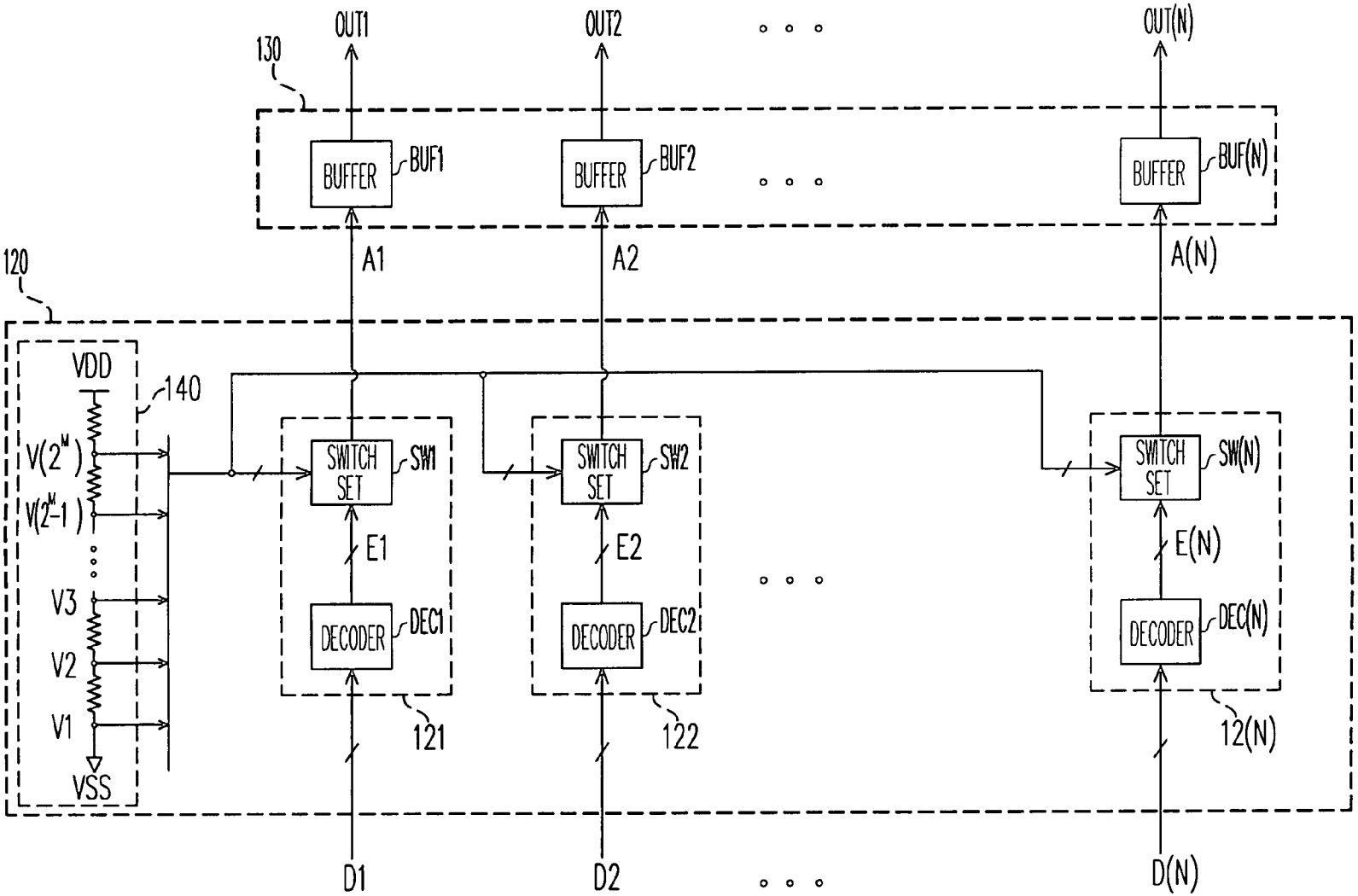
FIG. 2 (PRIOR ART)
FIG. 2 shows a detailed block diagram of the D/A converting unit 120 and the output buffer 130 of FIG. 1A.
Figures 3A, 3B:
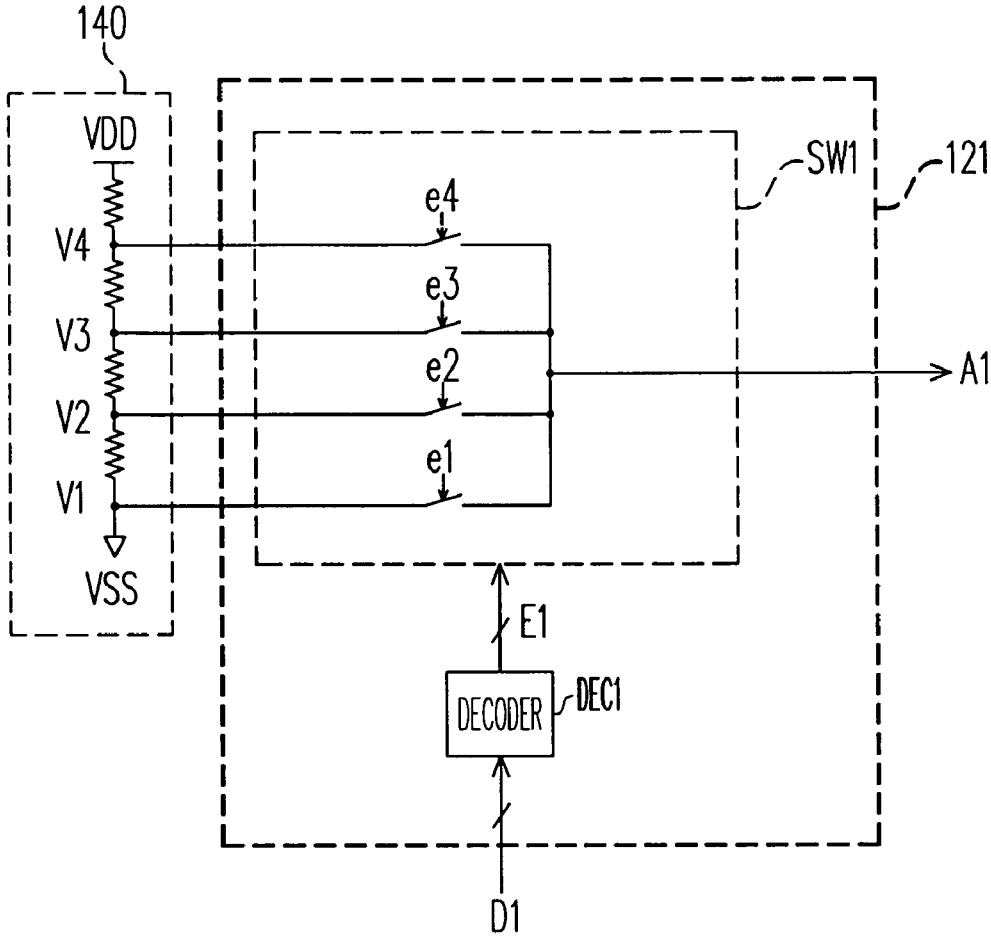
FIG. 3A(PRIOR ART)
FIG. 3B(PRIOR ART)
FIG. 3A shows an embodiment of the D/A converter 121 of FIG. 2.
FIG. 3B shows a relationship table between the decoded digital data E1 of FIG. 3A and the analog data A1.
Figures 3C, 3D:
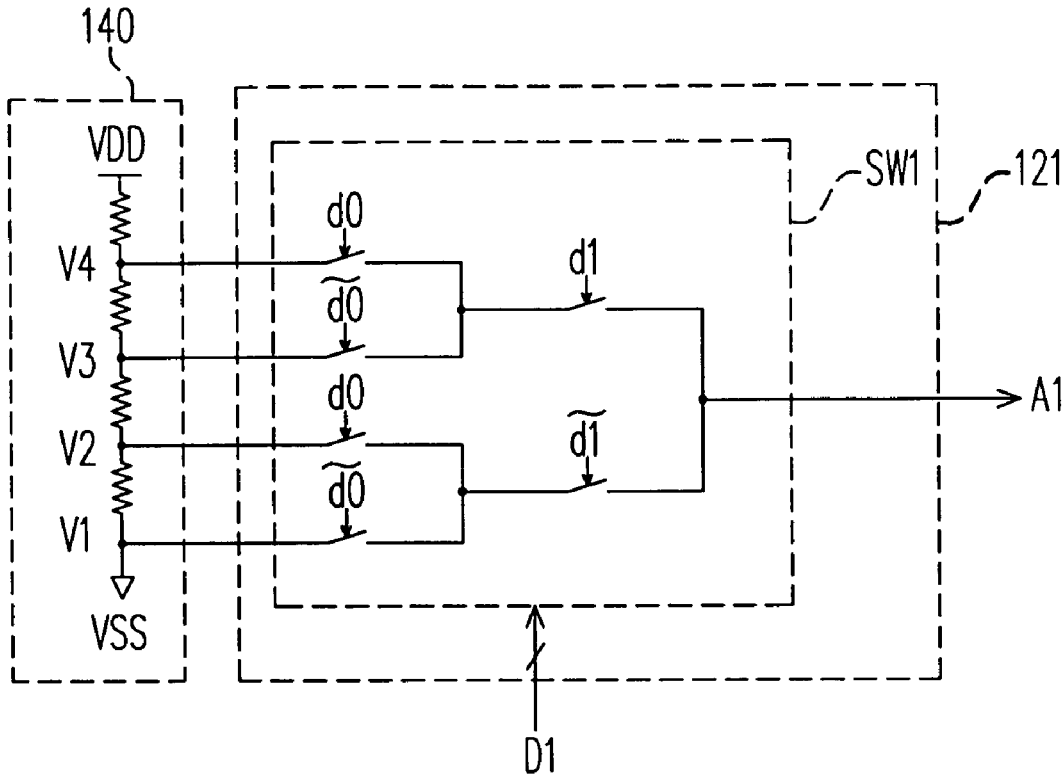
FIG. 3C(PRIOR ART)
FIG. 3D(PRIOR ART)
FIG. 3C shows another embodiment of the D/A converter 121 of FIG. 2.
FIG. 3D shows a relationship table between the digital data D1 of FIG. 3C and the analog data A1.

Referring to FIGS. 4 and 1B, the shift register 411 is triggered by the clock signal CLK and the first control signal CT1, and the second line latch 413 is controlled by the second control signal CT2. When the first control signal CT1 is transited to the high level, the shift register 411 sequentially shifts the received first control signal CT1 according to the clock signal CLK, and provides (N/3) latch signals of different phases to the first line latch 412. Then, the first line latch 412 receives and latches the input digital data stream IN1, IN2 and IN3 according to the latch signal provided by the shift register 411, wherein the digital data stream IN1, IN2, and IN3 respectively represents the red (R), green (G), and blue (B) pixel data, and each pixel data is represented by M bits.

When the entire line latch is filled with the digital data stream that is latched in the first line latch 412, the second control signal CT2 transits to the high level, thus the digital data latched in the first line latch 412 is transmitted and latched in the second line latch 413. Then, the level shifter 414 converts the digital data latched in the second line latch 413 into the data with a higher voltage level so as to accurately drive the D/A converting unit 420. The D/A converting unit 420 receives N digital data D1~D(N) that is provided by the level shifter 414 and represented by M bits, and converts the received digital data D1~D(N) into the corresponding N analog data OUT1~OUT(N) to drive the display panel. Then, the clock signal CLK and the first control signal CT1 transit to the high level again, thus the data in the first line latch 412 is refreshed and latched, and the processes mentioned above are repeated.

D/A converting unit 420 comprises a grey-level voltage generator 440 and K sub D/A converting units 421~42(K), where K is a positive integer. The grey-level voltage generator 440 provides $2^M$ grey-level voltages, i.e. V1~V($2^M$), and none of the levels of V1~V($2^M$) are the same. In addition, each sub D/A converting unit 412~42(K) comprises $2^M$ buffers and $$\frac{N}{A}D/A$$

converters, where $$\frac{N}{K}$$

is a positive integer.

FIG. 5A shows an embodiment of the sub D/A converting unit 421 and the grey-level voltage generator 440 of FIG. 4. Referring to FIG. 5A, the sub D/A converting unit 421 comprises $2^M$ buffers, i.e. BUF1~BUF($2^M$). Each buffer receives and outputs a corresponding grey-level voltage. In other words, the buffer BUF1 receives and outputs the grey-level voltage V1, the buffer BUF2 receives and outputs the grey-level voltage V2, . . . , and the buffer BUF($2^M$) receives and outputs the grey-level voltage V($2^M$).

In addition, the sub D/A converting unit 421 further comprises $$\frac{N}{A}D/A$$

converters, i.e.

$$521 \sim 52\left(\frac{N}{K}\right).$$

Each D/A converter comprises a decoder and a switch set. In other words, the D/A converter 521 comprises the decoder DEC1 and the switch set SW1, the D/A converter 522 comprises the decoder DEC2 and the switch set SW2, . . . , and the D/A converter $$52\left(\frac{N}{K}\right)$$

comprises the decoder $$DEC\left(\frac{N}{K}\right)$$

and the switch set $$SW\left(\frac{N}{K}\right).$$

Using the D/A converter 521 of the sub D/A converting unit 421 as an example, the decoder DEC1 receives and decodes the first digital data D1, and generates a decoded digital data E1. The switch set SW1 coupled to the decoder DEC1 and the buffers BUF1~BUF($2^M$) selects one of the grey-level voltages V1~V($2^M$) that had passed the buffers BUF1~BUF ($2^M$) as the first analog data output OUT1 according to the decoded digital data E1.

As for the D/A converter 52(*j*) of the sub D/A converting unit 42(*i*), the decoder DEC(j) receives and decodes the digital data $$D\left((i-1)\times\frac{N}{K}+j\right),$$

and generates the decoded digital data $$E\left((i-1)\times\frac{N}{K}+j\right).$$

The switch set SW(j) coupled to the decoder DEC(j) and the buffers BUF1~BUF($2^M$) selects one of the grey-level voltages V1~V($2^M$) that had passed the buffers BUF1~BUF($2^M$) as the analog data $$\mathrm{OUT}\left((i-1)\times\frac{N}{K}+j\right)$$

according to the decoded digital data $$E\left((i-1)\times\frac{N}{K}+j\right),$$

where i and j are the positive integers, $$1\le i\le K \text{ and } 1\le j\le\frac{N}{K}.$$

FIG. 5B shows another embodiment of the sub D/A converting unit 421 and the grey-level voltage generator 440 of FIG. 4. Referring to FIG. 5B, the sub D/A converting unit 421 comprises $2^M$ buffers, i.e. BUF1~BUF($2^M$). Each buffer receives and outputs a corresponding grey-level voltage. In other words, the buffer BUF1 receives and outputs the grey-level voltage V1, the buffer BUF2 receives and outputs the grey-level voltage V2, . . . , and the buffer BUF($2^M$) receives and outputs the grey-level voltage V($2^M$).

In addition, the sub D/A converting unit 421 further comprises $$\frac{N}{K}D/A$$

converters, i.e.

$$521\sim 52\left(\frac{N}{K}\right).$$

Each D/A converter comprises a switch set. In other words, the D/A converter 521 comprises the switch set SW1, the D/A converter 522 comprises the switch set SW2, . . . , and the D/A converter $$52\left(\frac{N}{K}\right)$$

comprises the switch set $$SW\left(\frac{N}{K}\right).$$

Using the D/A converter 521 of the sub D/A converting unit 421 as an example, the switch set SW1 coupled to the buffers BUF1~BUF($2^M$) selects one of the grey-level voltages V1~V($2^M$) that had passed the buffers BUF1~BUF($2^M$) as the first analog data output OUT1 according to the received first digital data D1.

As for the D/A converter 52(*j*) of the sub D/A converting unit 42(*i*), the switch set SW(j) coupled to the buffers BUF1~BUF($2^M$) selects one of the grey-level voltages V1~V($2^M$) that had passed the buffers BUF1~BUF($2^M$) as the analog data $$\mathrm{OUT}\left((i-1)\times\frac{N}{K}+j\right)$$

according to the received digital data $$D\left((i-1)\times\frac{N}{K}+j\right),$$

where i and j are the positive integers, $$1\le i\le K \text{ and } 1\le j\le\frac{N}{K}.$$

FIGS. 6A~6C show other optional embodiments of the grey-level voltage generator 440 of FIGS. 5A and 5B. Referring to FIG. 6A, the grey-level voltage generator 440 of FIG. 6A and the grey-level voltage generator 440 of FIGS. 5A and 5B all use the $2^M$ serially-connected resistors to divide the supply voltage difference (VDD−VSS), and it is differed in that the grey-level voltage generator 440 of FIG. 6A provides the grey-level voltages V2~V($2^M$+1) for the sub D/A converting unit, whereas the grey-level voltage generator 440 of FIGS. 5A and 5B provides the grey-level voltages V1~V($2^M$) for the sub D/A converting unit.

Similarly, referring to FIG. 6B, the ($2^M$−1) serially-connected resistors are used to divide the supply voltage difference (VDD−VSS), and the grey-level voltage generator 440 of FIG. 6B provides the grey-level voltages V1~V($2^M$) for the sub D/A converting unit. Referring to FIG. 6C, the ($2^M$+1) serially-connected resistors are used to divide the supply voltage difference (VDD−VSS), and the grey-level voltage generator 440 of FIG. 6C provides the grey-level voltages V1~V($2^M$) for the sub D/A converting unit. The voltages of VDD and VSS in FIGS. 6A~6C are provided by a supply voltage, a voltage buffer, or a voltage regulator.

In summary, since the buffer of the data driver in the present invention is disposed between the D/A converter and the grey-level voltage generator, the N buffers required in this configuration are decreased to $K\times2^M$ buffers. As for a 480-channel (N=480) 6-bit (M=6) data driver, if the D/A converters are divided into 4 groups (K=4), the present invention can effectively decrease 224 ($480-4\times2^6=224$) buffers in comparison to the conventional configuration, which significantly reduces the cost, power consumption, and heat generated thereon.

Although the invention has been described with reference to a particular embodiment thereof, it will be apparent to one of the ordinary skills in the art that modifications to the described embodiment may be made without departing from the spirit of the invention. Accordingly, the scope of the invention will be defined by the attached claims not by the above detailed description.

What is claimed is:

1. A digital data driver, comprising:

a receiving unit for receiving at least one digital data stream and converting the received digital data stream into N digital data, wherein each of the digital data is M bits, and M and N are the positive integers; and a digital-to-analog (D/A) converting unit for receiving the digital data, and converting the received digital data into corresponding N analog data, wherein the D/A converting unit comprises:

a grey-level voltage generator for providing $2^M$ grey-level voltages; and

K sub D/A converting units, wherein the $i^{th}$ sub D/A converting unit comprises:

$2^M$ buffers, wherein each of the buffers receives and outputs corresponding one of the grey-level voltages; and $$\frac{N}{K}D/A$$

converters, wherein the $j^{th}$ D/A converter receives the $$\left[(i-1)\times\frac{N}{K}+j\right]^{th}$$

digital data, and selects and outputs one of the grey-level voltages that passed the buffers as the $$\left[(i-1)\times\frac{N}{K}+j\right]^{th}$$

analog data according to the $$\left[(i-1)\times\frac{N}{K}+j\right]^{th}$$

digital data, where K, $$\frac{N}{K},$$

i and j are the positive integers, $$1\leqq i\leqq K \text{ and } 1\leqq j\leqq\frac{N}{K}.$$

2. The digital data driver of claim 1, wherein the at least one digital data stream comprises a grey-level digital data stream.

3. The digital data driver of claim 1, wherein the at least one digital data stream comprises a red (R) digital data stream, a green (G) digital data stream and a blue (B) digital data stream.

4. The digital data driver of claim 1, wherein the receiving unit comprises:

a shift register for sequentially shifting a received first control signal according to a clock signal and providing latch signals;

a first line latch coupled to the shift register for receiving and latching the at least one digital data stream according to the latch signals; and a second line latch coupled to the first line latch for receiving and latching a latch result of the first line latch according to a second control signal and outputting a latch result of the second line latch as the digital data.

5. The digital data driver of claim 1, wherein the receiving unit comprises:

a shift register for sequentially shifting a received first control signal according to a clock signal and providing latch signals;

a first line latch coupled to the shift register for receiving and latching the at least one digital data stream according to the latch signals;

a second line latch coupled to the first line latch for receiving and latching a latch result of the first line latch according to a second control signal; and a level shifter coupled to the second line latch for adjusting the level of a latch result of the second line latch as the digital data to output.

6. The digital data driver of claim 1, wherein the $j^{th}$ D/A converter comprises:

a switch set coupled to the buffers for selecting and outputting one of the grey-level voltages that passed the buffers as the $$\left[(i-1)\times\frac{N}{K}+j\right]^{th}$$

analog data according to the received $$\left[(i-1)\times\frac{N}{K}+j\right]^{th}$$

digital data.

7. The digital data driver of claim 1, wherein the $j^{th}$ D/A converter comprises:

a decoder for receiving and decoding the $$\left[(i-1)\times\frac{N}{K}+j\right]^{th}$$

digital data to generate a decoded digital data; and a switch set coupled to the decoder and the buffers for selecting and outputting one of the grey-level voltages that passed the buffers as the $$\left[(i-1)\times\frac{N}{K}+j\right]^{th}$$

analog data according to the decoded digital data.

8. A display device comprising the digital data driver of claim 1.

9. The display device of claim 8, wherein the display device comprises a Liquid Crystal Display (LCD) device.

10. A digital-to-analog (D/A) converting unit for receiving N digital data and converting the received N digital data into corresponding N analog data, wherein each of the digital data is M bits, and M and N are the positive integers, the D/A converting unit comprising:

a grey-level voltage generator for providing $2^M$ grey-level voltages; and

K sub D/A converting units, wherein the $i^{th}$ sub D/A converting unit comprises:

$2^M$ buffers, wherein each of the buffers receives and outputs corresponding one of the grey-level voltages; and $$\frac{N}{K}D/A$$

converters, wherein the $j^{th}$ D/A converter receives the $$\left[(i-1)\times\frac{N}{K}+j\right]^{th}$$

digital data, and selects and outputs one of the grey-level voltages that passed the buffers as the $$\left[(i-1)\times\frac{N}{K}+j\right]^{th}$$

analog data according to the $$\left[(i-1)\times\frac{N}{K}+j\right]^{th}$$

digital data, where K, $$\frac{N}{K},$$

i and j are the positive integers, $$1 \leqq i \leqq K \text{ and } 1 \leqq j \leqq \frac{N}{K}.$$

11. The D/A converting unit of claim 10, wherein the $j^{th}$ D/A converter comprises:

a switch set coupled to the buffers for selecting and outputting one of the grey-level voltages that passed the buffers as the $$\left[(i-1)\times\frac{N}{K}+j\right]^{th}$$

analog data according to the received $$\left[(i-1)\times\frac{N}{K}+j\right]^{th}$$

digital data.

12. The D/A converting unit of claim 10, wherein the $j^{th}$ D/A converter comprises:

a decoder for receiving and decoding the $$\left[(i-1)\times\frac{N}{K}+j\right]^{th}$$

digital data to generate a decoded digital data; and a switch set coupled to the decoder and the buffers for selecting and outputting one of the grey-level voltages that passed the buffers as the $$\left[(i-1)\times\frac{N}{K}+j\right]^{th}$$

analog data according to the decoded digital data.

* * * * *